United States Patent [19]

DiGiusto

[11] Patent Number: 4,918,803

[45] Date of Patent: Apr. 24, 1990

[54] PLANT FOR ROLLING LONG PRODUCTS FROM BILLETS AND BLOOMS COMING FROM A PLURALITY OF CONTINUOUS CASTING LINES

[75] Inventor: Bruno DiGiusto, Udine, Italy

[73] Assignee: Danieli & C. Officine Meccaniche SpA, Buttrio, Italy

[21] Appl. No.: 220,684

[22] Filed: Jul. 18, 1988

[30] Foreign Application Priority Data

Aug. 5, 1987 [IT] Italy ..... 83428 A/87

[51] Int. Cl.[5] ..... B21B 1/26; B21B 1/46; B21B 13/22; B22D 11/12

[52] U.S. Cl. ..... 29/33 C; 29/527.7; 72/202

[58] Field of Search ..... 29/527.7, 33 C; 72/128, 72/200, 202, 342; 164/417, 476

[56] References Cited

U.S. PATENT DOCUMENTS

| | | | |
|---|---|---|---|
| 3,385,579 | 5/1968 | Peck et al. | 263/6 |
| 4,170,815 | 10/1979 | Tokitsu | 29/527.7 |

FOREIGN PATENT DOCUMENTS

| | | | |
|---|---|---|---|
| 1025924 | 3/1958 | Fed. Rep. of Germany . | |
| 3525457 | 1/1987 | Fed. Rep. of Germany . | |
| 57-121806 | 7/1982 | Japan | 29/527.7 |
| 61-176402 | 8/1986 | Japan | 29/527.7 |

OTHER PUBLICATIONS

Patent Abstracts of Japan, vol. 8, No. 122 (C-227)[1559], 8th June 1984; & JP-A-59 35 616 (Shin Nippon) 27-02-1984 (the whole abstract).

Patent Abstracts of Japan, vol. 7, No. 205 (C-185)[1350], 9th September 1983; & JP-A-58 104 113 (Shin Nippon) 21-06-1983 (the whole abstract).

*Primary Examiner*—E. Michael Combs

*Attorney, Agent, or Firm*—Wegner & Bretschneider

[57] ABSTRACT

Plant (10) for rolling long products from billets and blooms (30) coming from at least two continuous casting lines (11), each of said at least two lines (11) being provided with a shears (12), said plant comprising a temperature-equalizing furnace (16) disposed downstream of said shears (12) and containing an intake roller conveyor (17) for each of said at least two continuous casting lines (11), a discharge conveyor (18) disposed in an intermediate position between said at least two lines (11), and transversely-moving conveyors (21, 26) for transferring said billets or blooms (30) from said intake conveyors (17) to said discharge conveyor (18), said temperature-equalizing furnace (16) further comprising fixed supports (19) located between said intake roller conveyors (17) and said discharge conveyor (18), said fixed supports (19) defining a zone of equalization of the temperature of said blooms and billets (30), and at least some (25) of the rollers belonging to said intake roller conveyor (17) being vertically and transversely displaceable for constituting said discharge conveyor (18).

12 Claims, 3 Drawing Sheets

Figure 1:
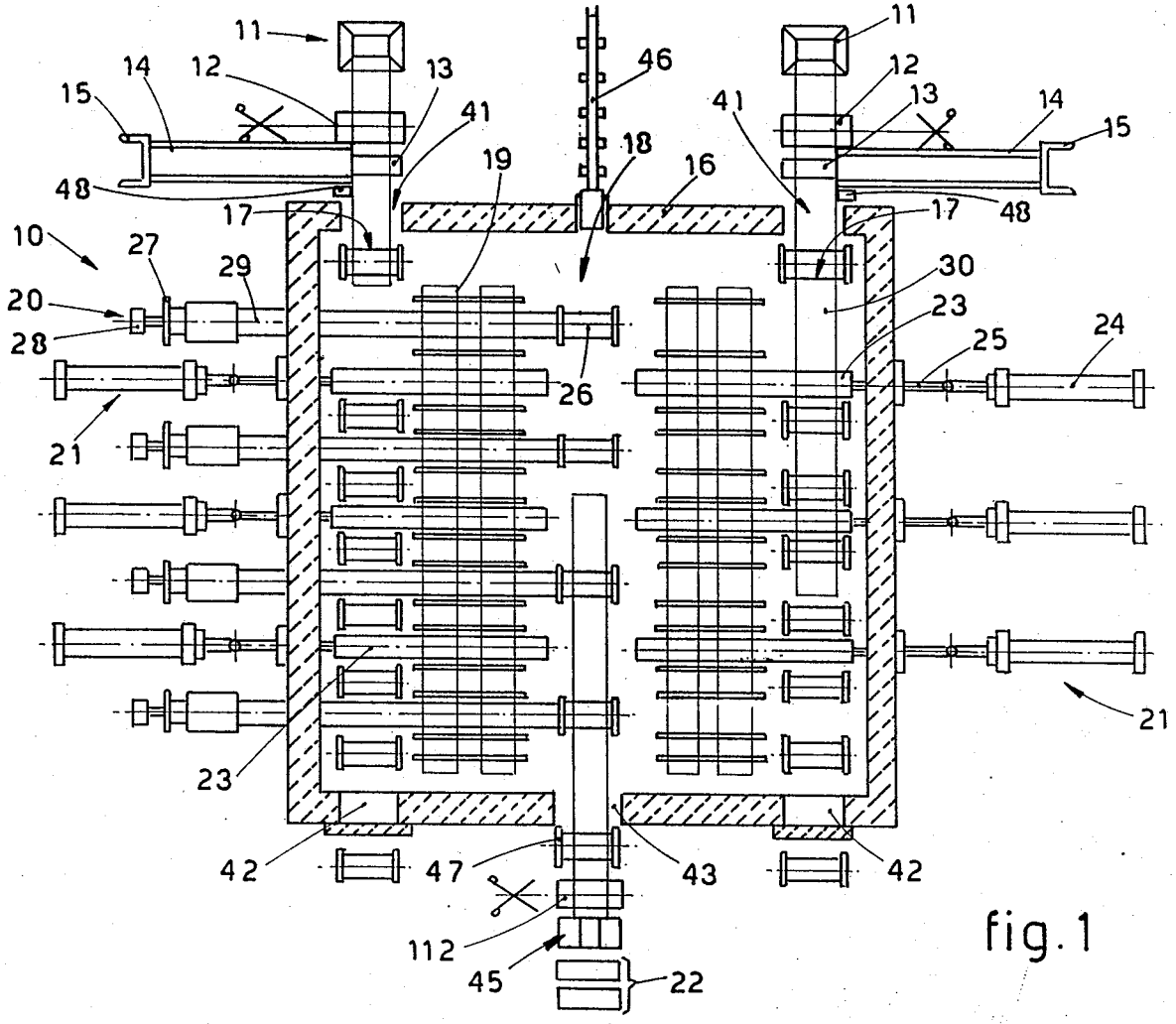

PLANT FOR ROLLING LONG PRODUCTS FROM BILLETS AND BLOOMS COMING FROM A PLURALITY OF CONTINUOUS CASTING LINES

This invention concerns a plant for rolling long products from billets and blooms coming from a plurality of continuous casting lines. The invention therefore concerns a plant for rolling sections and bars and, more generally, for rolling long products produced from billets or blooms supplied by a plurality of continuous casting lines.

Document DE-A-3,525,457 discloses a plant for rolling of metal strips starting from a continuously casted material in the form of a strip.

Said material is inserted into a heating or temperature-equalising furnace in order to obtain an optimized strip quality by means of modifying certain parameters.

The furnace comprises intake roller conveyors, a discharge roller conveyor and transversal conveyors the structure of which is not defined.

Document JP-A-59-35616 discloses a device for charging blooms or billets to be heated into a furnace.

Said device picks up said blooms or billets from a roller conveyor by means of a carriage and inserts them transversely inside of the heating furnace.

Document JP-A-58-104113 discloses a heating furnace for blooms or billets coming from a continuous casting line or from a cooling bed.

The cold blooms are held inside of the furnace for a longer time than the hot blooms.

Transversal conveyor comprised inside of the furnace provide to shift the blooms towards a discharge conveyor.

Furthermore a plant is known which comprises, downstream of two continuous casting lines positioned side by side, a heated tunnel followed by a lateral transversing conveyor, followed in turn by a discharge conveyor and a temperature-equalising furnace.

This plant is very burdensome as regards the space occupied, plant required, machines, maintenance and, above all, as regards energy consumption.

It is a purpose of the present invention to avoid the above drawbacks and to provide an economical plant as regards design and construction, maintenance and, above all, energy consumption.

This is obtained by a plant having the features disclosed in claim 1.

The dependent claims describe advantageous forms of embodiment of the invention.

According to the invention two or more continuous casting lines serve a temperature-equalizing furnace which includes on its median line a discharge roller conveyor.

A measurement system which is suitable to read the length of the billet or bloom entering the furnace is provided in cooperation with the inlet of the equalizing furnace. This measurement system is enabled to actuate the shears positioned at the furnace inlet to proceed with shearing when the length of the billet or bloom coincides with the value of the weight of the strip or of the final roll of strip or, in any event, of the material to be obtained.

According to the invention, when the billet or bloom has been sheared to size, it is accelerated within the equalizing furnace by variable-speed drive rollers included in the furnace. This acceleration serves to distance the tail of the sheared billet or bloom from the head of the next billet or bloom.

The length of the equalizing furnace is normally dimensioned in such a way as to contain a billet or bloom sheared to size, plus a length corresponding to the time required for the temperature of the billet or bloom to be made uniformly homogeneous, plus an interspace to be determined between the head and tail of two consecutive billets or blooms.

Intermediate supports forming a temperature equalizing and homogenizing zone, are comprised between the intake roller conveyors and the median discharge roller conveyor; the billets or blooms coming from the intake roller conveyors are placed temporarily for their general temperature-equalizing in depth on those intermediate supports.

The median discharge roller conveyor can be driven or can consist of idler rollers and may include on its axis a thruster.

According to a variant of the invention at least one lateral discharge conveyor is comprised between the shears and furnace so as to remove blooms or billets sheared by the shears whenever the continuous casting line is required to continue working in the event of obstacles or repair work taking place downstream.

A toroidal induction heater is included advantageously downstream of the equalizing furnace and enables the temperature of the furnace to be kept 50°-120° C. lower than that which would otherwise be required, for this temperature is recovered by the toroidal heater.

According to another form of embodiment, the plant comprises a heating furnace disposed downstream of the equalizing furnace.

Figure 2:
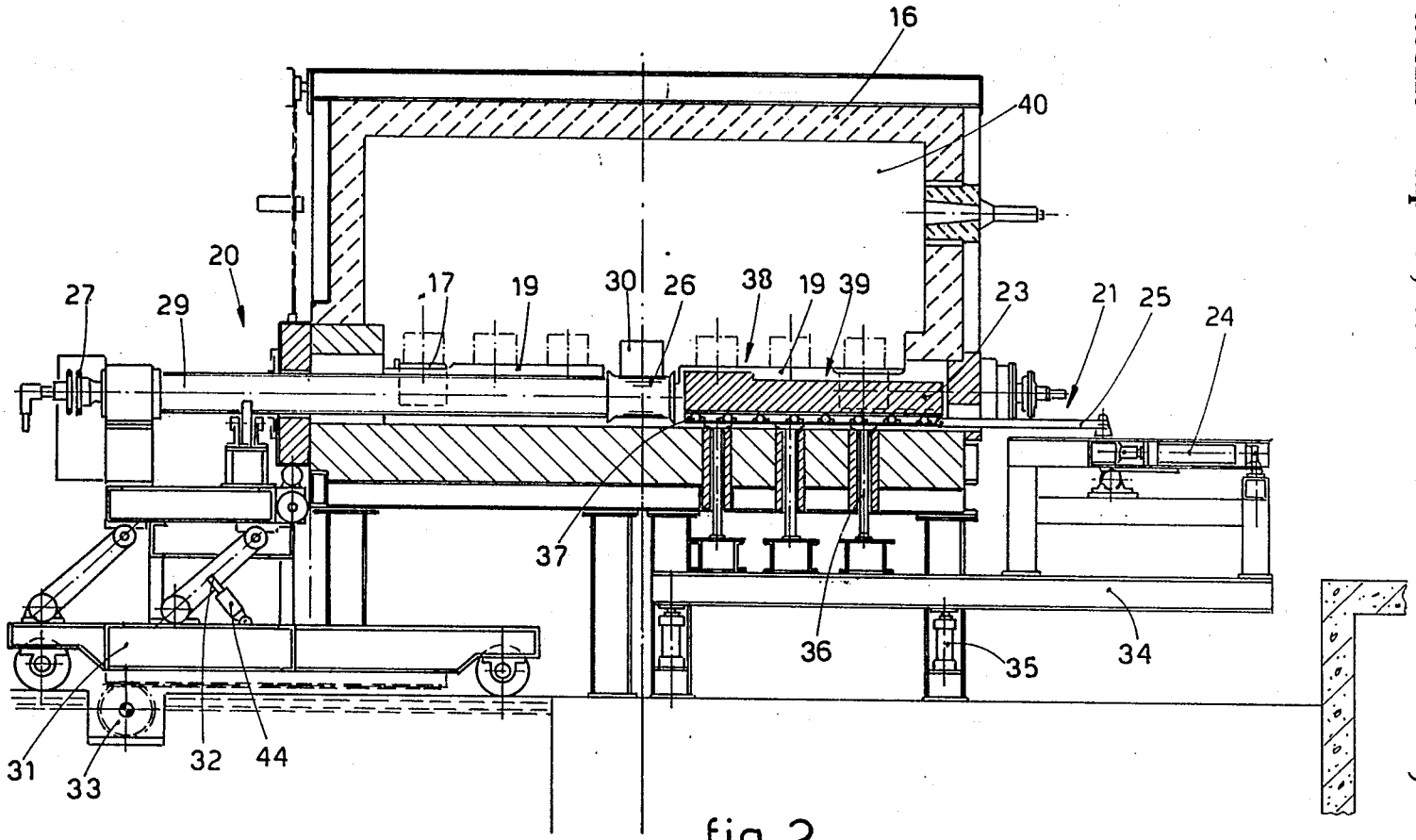
Figure 3:
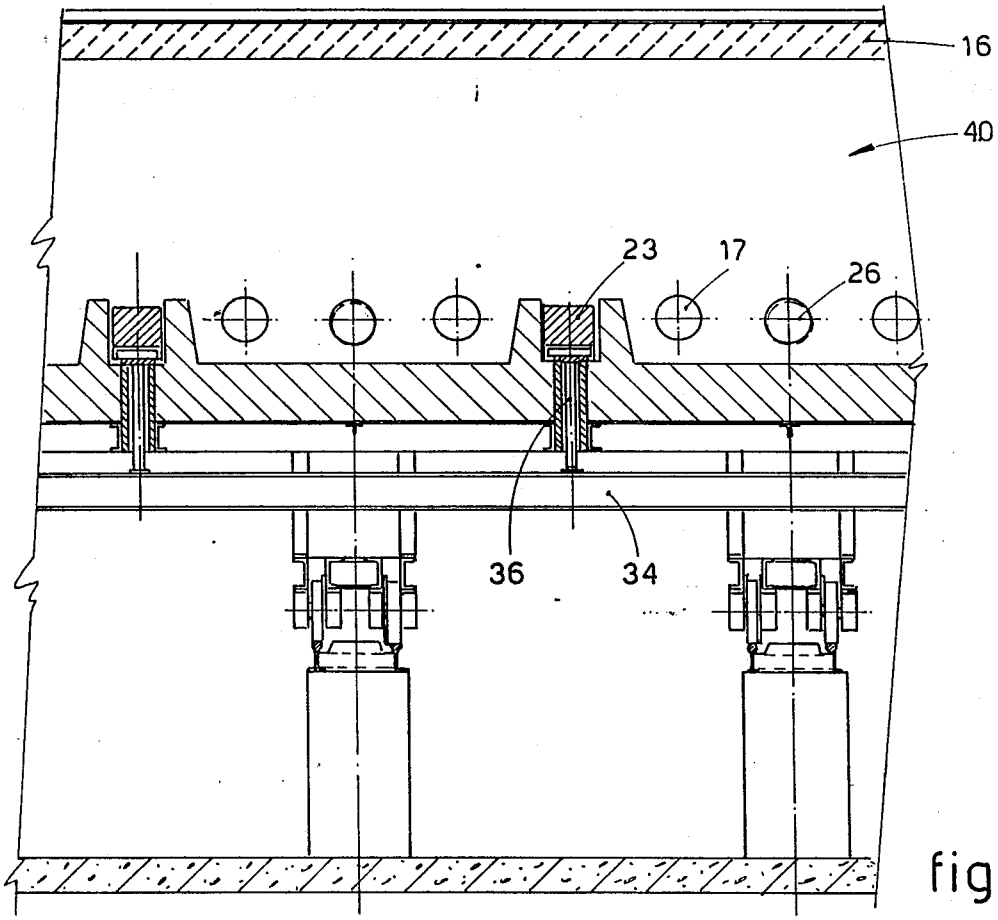

The attached figures, which are given as a non-restrictive example, show the following:

FIG. 1 gives a plan view of a plant according to the invention;

FIG. 2 gives a cross section of a furnace suitable to serve the plant of the invention;

FIG. 3 shows a partial lengthwise section of the furnace of FIG. 2.

In the figures each of two continuous casting lines 11 of a plant 10 comprises a shears 12 and, in this case, a traversing conveyor 13, which serves a cooling traversing conveyor 14 equipped terminally, for instance, with a stacker 15.

The traversing conveyor 13 and its relative cooling traversing conveyor 14 are required when it is decided to continue the continuous casting even when an obstacle occurs downstream. In such a case the shears 12 shears to the required length the bloom or billet coming from the continuous casting lines 11.

The continuous casting lines 11 serve intake roller conveyors 17 which accept billets or blooms 30 coming from the continuous casting operations.

Each casting line may be equipped with means 48 to measure the length of billets or blooms entering a temperature-equalizing furnace 16; such measurement means 48 controls the shears 12.

The rollers of the intake roller conveyors 17 are cooled and driven.

Supports 19 positioned crosswise to the intake roller conveyors 17 are comprised within the furnace 16 and are able to support momentarily one or more billets or blooms 30 sheared to the required length by the shears 12 and introduced into a chamber 40 of the furnace 16 along the intake roller conveyors 17 through inlet doors 41.

Said supports define a temperature homogenizing and equalizing zone within which the temperature of said billets is homogeneously distributed.

A discharge roller conveyor 18 served by discharge rollers 26 is included centrally and comprises at its downstream end a terminal shears 112 located upstream of a rolling train 22. This discharge conveyor 18 cooperates with an outlet 43 for billets and blooms.

The intake conveyors 17 may comprise terminal safety outlets 42 when for any reason it is necessary to discharge in a direct line the billets or blooms 30 positioned on the intake conveyors 17.

According to the invention the billet or bloom as formed on the continuous casting line 11 and arriving with the required length on the intake conveyor 17 is traversed laterally by an internal traversing means 21, which deposits the billet or bloom 30 first of all on the supports 19 of the temperature homogenizing zone and makes it move forward thereon and places it next on the discharge rollers 26 of a roller support device 20.

According to the invention, as the device 20 which supports the discharge rollers 26 is able to traverse them axially and displace them vertically, it is possible to arrange that those rollers 26 themselves move in coordination to take the billet or bloom 30 directly from the supports 19 and to deliver it to the discharge conveyor 18.

When the billet or bloom 30 has been placed on the discharge conveyor 18, it is progressively accelerated until it reaches the speed of the first stand of the rolling train 22 so as to be rolled. This acceleration may be imparted by the discharge rollers 26 or by the same in cooperation with an outlet drawing roller unit 47.

Discharge of the billet or bloom from the discharge conveyor 18 may also take place by cooperation of a thruster 46, which may be assisted by the outlet drawing roller unit 47.

While the billet or bloom 30 is progressively drawn into the rolling operation, the other billets 30 are fed into the furnace 16 and traversed therein to await their turn for processing.

Each discharge roller 26 may have a stationary position or be able to move axially and perhaps vertically. If it is movable, it is supported on a support arm 29, which in turn is served by a trolley 31 suitable to move crosswise to the furnace 16 owing to a driven wheel 33 that cooperates in this instance with a rack comprised on the trolley 31.

The trolley 31 upholds the support arm 29 by means of a parallelogram of levers 32 which can be moved vertically to the required extent by a jack 44.

In this way, when the bloom or billet 30 is discharged by the discharge conveyor 18, it is possible, while waiting to discharge a successive billet or bloom, to lower first the discharge rollers 26 and then to withdraw them momentarily so that they do not become overheated by remaining in the furnace 16 unnecessarily.

With this system the discharge rollers 26, moving in coordination, may themselves move to take the blooms or billets 30 from the support 19.

The discharge rollers 26 shown are driven at 27 and are cooled by a forced circulation of water through an intake 28.

As regards the system of feed by means of the internal traversing means 21, this traversing means 21 comprises an arm 23 able to move in a straight line and vertically and supported on a carriage 37 with rollers, the carriage 37 being moved vertically by shafts 36 supported on a frame 34. In this example the frame 34 is displaced vertically by jacks 35.

The frame 34 comprises also a horizontal jack 24 which displaces the movable arm 23 axially by a required value by means of a rod 25.

The movable arm 23 comprises a rear lower portion 39 and a front higher portion 38; this conformation makes it possible to take with a normal movement the blooms or billets 30 positioned on the intake conveyors 17 and supports 19 and to make them advance in a required manner.

In order to take the bloom or billet 30 located on the intake conveyor 17, the vertical jacks 35 perform a longer travel, thus raising the bloom or billet 30 higher and displacing it onto the support 19 of the temperature-equalizing and homogeneizing zone, where the temperature of said bloom is homogenized.

The movable arm 23 then takes the bloom or billet from the support 19 and places it on the discharge conveyor 18, which has been reconstituted in the meantime by return of the roller 26.

A scaling means and, in cooperation therewith, the toroidal heater 45 are positioned downstream of the outlet 43 of the discharge conveyor 18.

I claim:

1. A plant for rolling long products from billets and blooms coming from at least two continuous casting lines, each said at least two continuous casting lines including a shears, said plant comprising a temperature-equalizing furnace disposed downstream of the shears and comprising an inlet in the temperature-equalizing furnace downstream of each said at least two continuous casting lines, an intake roller conveyor downstream of each said inlet, fixed supports defining a zone of equalization of the temperature of the billets and blooms, a discharge rollery conveyor disposed in an intermediate position in said temperature-equalizing furnace between said intake roller conveyors, said discharge roller conveyor including discharge rollers supported by a roller support device, said roller support device including means for transversely and vertically displacing said discharge rollers, internal traversing means for transferring the billets and blooms from said intake roller conveyors to said fixed supports and for moving the billets and blooms on said fixed supports to said discharge rollers of said discharge roller conveyor, and an outlet in the temperature-equalizing furnace downstream of said discharge roller conveyor.

2. A plant as recited in claim 1, further comprising a length measuring means upstream of each said intake roller conveyor, for actuating the respective shears of said at least two continuous casting lines.

3. A plant as recited in claim 1, wherein the temperature-equalizing furnace further includes a terminal safety outlet in a direct line downstream of each said intake roller conveyor.

4. A plant as recited in claim 1, further comprising a traversing conveyor between the shears of each said at least two continuous casting lines and the inlet of the temperature-equalizing furnace.

5. A plant as recited in claim 1, wherein said means for transversely and vertically displacing said discharge rollers includes means for momentarily withdrawing said discharge rollers from said temperature-equalizing furnace.

6. A plant as recited in claim 1, further comprising an outlet drawing roller means downstream of said discharge roller conveyor, for cooperating with the discharge roller conveyor to discharge the billets and blooms from the outlet of the temperature-equalizing furnace.

7. A plant as recited in claim 1, further comprising a thruster means upstream of said discharge roller conveyor, for cooperating with the discharge roller conveyor to discharge the billets and blooms from the outlet of the temperature-equalizing furnace.

8. A plant as recited in claim 1, wherein said internal traversing means comprises a movable arm, and means for axially and vertically displacing said movable arm.

9. A plant as recited in claim 8, wherein said movable arm comprises a rear lower portion and a front higher portion.

10. A plant as recited in claim 1, further comprising a terminal shears downstream of said outlet of the temperature-equalizing furnace, and a rolling train downstream of said terminal shears.

11. A plant as recited in claim 8, further comprising a toroidal induction heater between said terminal shears and said rolling train.

12. A plant as recited in claim 1, further comprising means for driving said discharge rollers.

* * * * *